US006264587B1

(12) United States Patent
Lee

(10) Patent No.: US 6,264,587 B1
(45) Date of Patent: Jul. 24, 2001

(54) EXERCISE WHEEL

(76) Inventor: Chin-Tsun Lee, No. 32, Lane 6, Kuokuang 7th St., Yung Kang City, Tainan Hsien (TW)

( * ) Notice: Subject to any disclaimer, the term of this patent is extended or adjusted under 35 U.S.C. 154(b) by 0 days.

(21) Appl. No.: 09/550,632

(22) Filed: Apr. 17, 2000

(51) Int. Cl.[7] ..... H63B 21/22
(52) U.S. Cl. ..... 482/132; 482/127; 482/907
(58) Field of Search ..... 482/132, 62, 127, 482/907, 116, 126, 121

(56) References Cited

U.S. PATENT DOCUMENTS

| | | | | |
|---|---|---|---|---|
| 3,752,475 | * | 8/1973 | Ott | 482/132 |
| 4,657,244 | * | 4/1987 | Ross | 482/62 |
| 5,707,325 | * | 1/1998 | Chiou | 482/132 |
| 6,017,296 | * | 1/2000 | Tang et al. | 482/132 |

* cited by examiner

*Primary Examiner*—Jerome W. Donnelly
(74) *Attorney, Agent, or Firm*—Charles E. Baxley

(57) ABSTRACT

An exercise wheel includes a housing, a chassis housed by the housing and including a compartment, a pair of rollers rotatably mounted in the compartment of the chassis and connected by a shaft, a main gear rotatably mounted in the compartment of the chassis, and a transmission gear for providing transmission between the shaft of the rollers and the main gear. Two torsion springs are respectively mounted to two sides of the main gear and each has a first end and a second end. The first end of each torsion spring is attached to an associated side of the main gear. The second end of each torsion spring is attached to the chassis. Each of the torsion springs is deformed to store resilience when the main gear is turned, thereby returning the main gear. Two grip rods are secured to the two sides of the housing, respectively. A universal caster is mounted to an underside of the chassis, thereby allowing the user to change moving direction of the exercise wheel.

11 Claims, 7 Drawing Sheets

EXERCISE WHEEL

BACKGROUND OF THE INVENTION

1. Field of the Invention

The present invention relates to an exercise wheel that has a longer travel, prevents backward displacement, and increases longevity of torsion springs. The present invention also relates to an exercise wheel that can be operated with less force and adjusted according to user's demand.

2. Description of the Related Art

FIGS. 6 and 7 of the drawings illustrates a conventional exercise wheel that includes a housing 1', two grip rods 2', a main gear 3', two roller pairs 4', and two torsion springs 5'. The housing 1' includes a compartment with a downwardly facing opening and aligned holes 11' on two sides thereof into which the grip rods 2' are mounted. Two stop rods 12' are mounted inside the housing 1'. The main gear 3' is mounted to the grip rods 2' and includes a peg 32' on each side thereof. Each roller pair 4' includes two rollers 41' connected by a shaft 42' that has teeth 421' formed on an outer periphery thereof for meshing with teeth 31' of the main gear 3'. Each torsion spring 5' includes two ends 52' and 53' that are attached to an associated peg 32' and an associated stop rod 12', respectively.

When in use, the user bends downward and grasps the grip rods 2' to make roller pairs 4' roll on the ground. During rolling of the roller pairs 4', the torsion springs 5' are tensioned by the main gear 3' via transmission of the teeth 421' and 31'. When the main gear 3' is turned for one turn the end 52' of the torsion spring 51' bears against the stop rod 12', and the main gear 3' and the roller pairs 4' are thus stopped. Thus, maximal travel of the exercise wheel is limited. The torsion springs 51' may return the exercise wheel to its initial position.

Nevertheless, it is found that the maximum travel for the exercise wheel corresponds to one turn of the main gear 3', which might be insufficient for the user whereby a larger gear is required for a longer travel. In addition, the torsion springs 5' might be damaged or even broken if the torsional travel is too large for the torsion springs 5'. As a result, the ends 52' and 53' of the torsion springs 5' might disengage from the stop rods 12' and the pegs 32' and thus cause injury to the user. Further, the roller pairs 4' are aligned one with the other such that the exercise wheel can be moved rectilinearly only.

SUMMARY OF THE INVENTION

It is an object of the present invention to provide an exercise wheel that allows curvilinear movement.

It is another object of the present invention to provide an exercise wheel that provides longer longevity for the torsion springs.

It is a further object of the present invention to provide an exercise wheel that allows a longer travel and prevents backward displacement.

In accordance with a first aspect of the invention, an exercise wheel comprises:

a housing having two sides, a chassis housed by the housing and including a compartment, a pair of rollers rotatably mounted in the compartment of the chassis and connected by a shaft, a main gear rotatably mounted in the compartment of the chassis and having two sides, means for providing transmission between the shaft of the rollers and the main gear, a pair of torsion springs respectively mounted to the two sides of the main gear and each having a first end and a second end, the first end of each said torsion spring being attached to an associated said side of the main gear, the second end of each said torsion spring being attached to the chassis, each said torsion spring being deformed to store resilience when the main gear is turned, thereby returning the main gear, two grip rods secured to the two sides of the housing, respectively, and a universal caster mounted to an underside of the chassis, thereby allowing the user to change moving direction of the exercise wheel.

In accordance with a second aspect of the invention, an exercise wheel comprises:

a housing having two sides, a chassis housed by the housing and including a compartment, a pair of rollers rotatably mounted in the compartment of the chassis and connected by a shaft, a main gear rotatably mounted in the compartment of the chassis and having two sides, a transmission gear for providing transmission between the shaft of the rollers and the main gear, the transmission gear being so constructed that the main gear is rotated through an angle less than 360° when the rollers are turned through 360°, a pair of torsion springs respectively mounted to the two sides of the main gear and each having a first end and a second end, the first end of each said torsion spring being attached to an associated side of the main gear, the second end of each said torsion spring being attached to the chassis, and two grip rods secured to the two sides of the housing, respectively.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
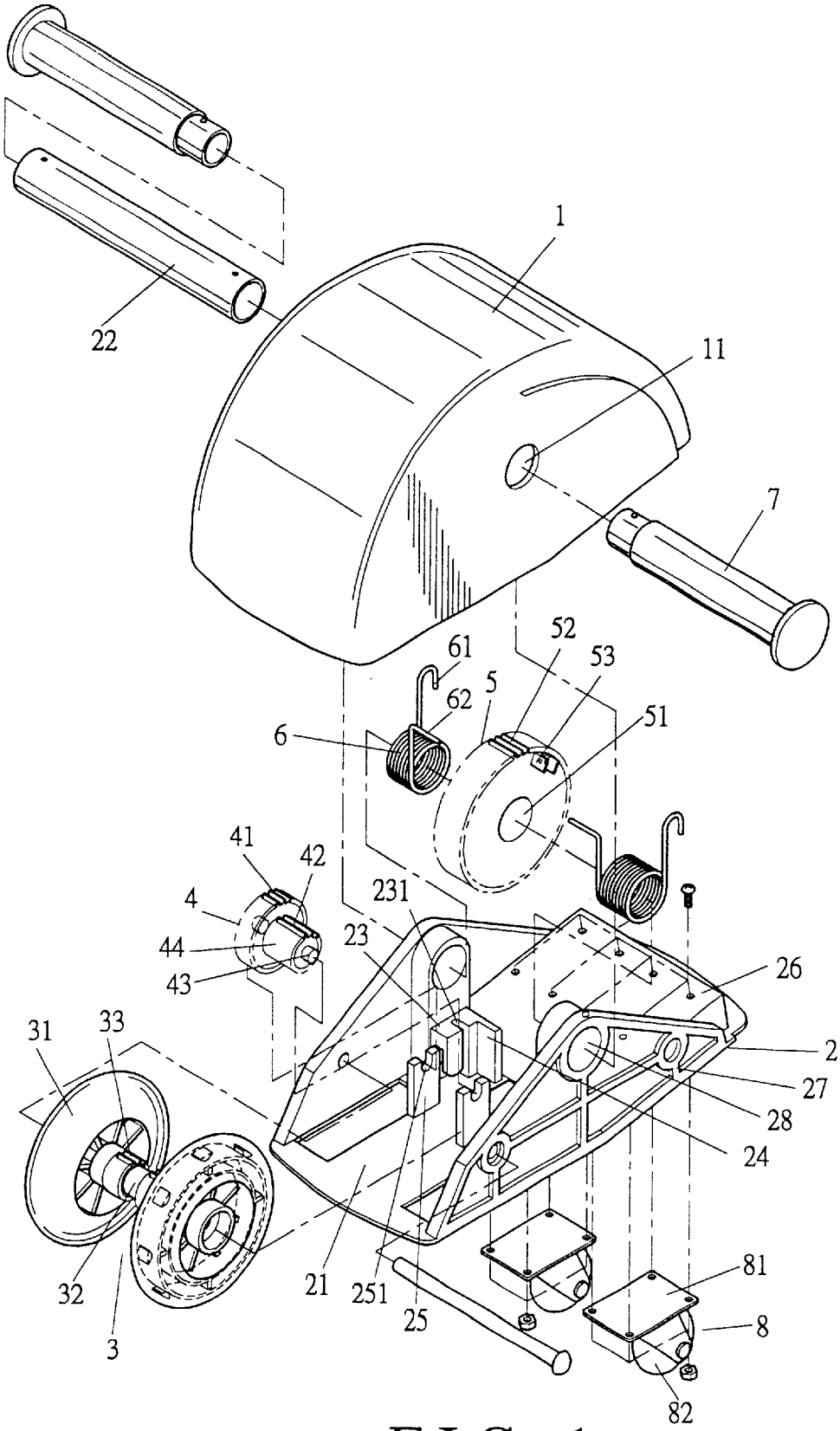
FIG. 1 is an exploded perspective view of a first embodiment of an exercise wheel in accordance with the present invention.
Figure 2:
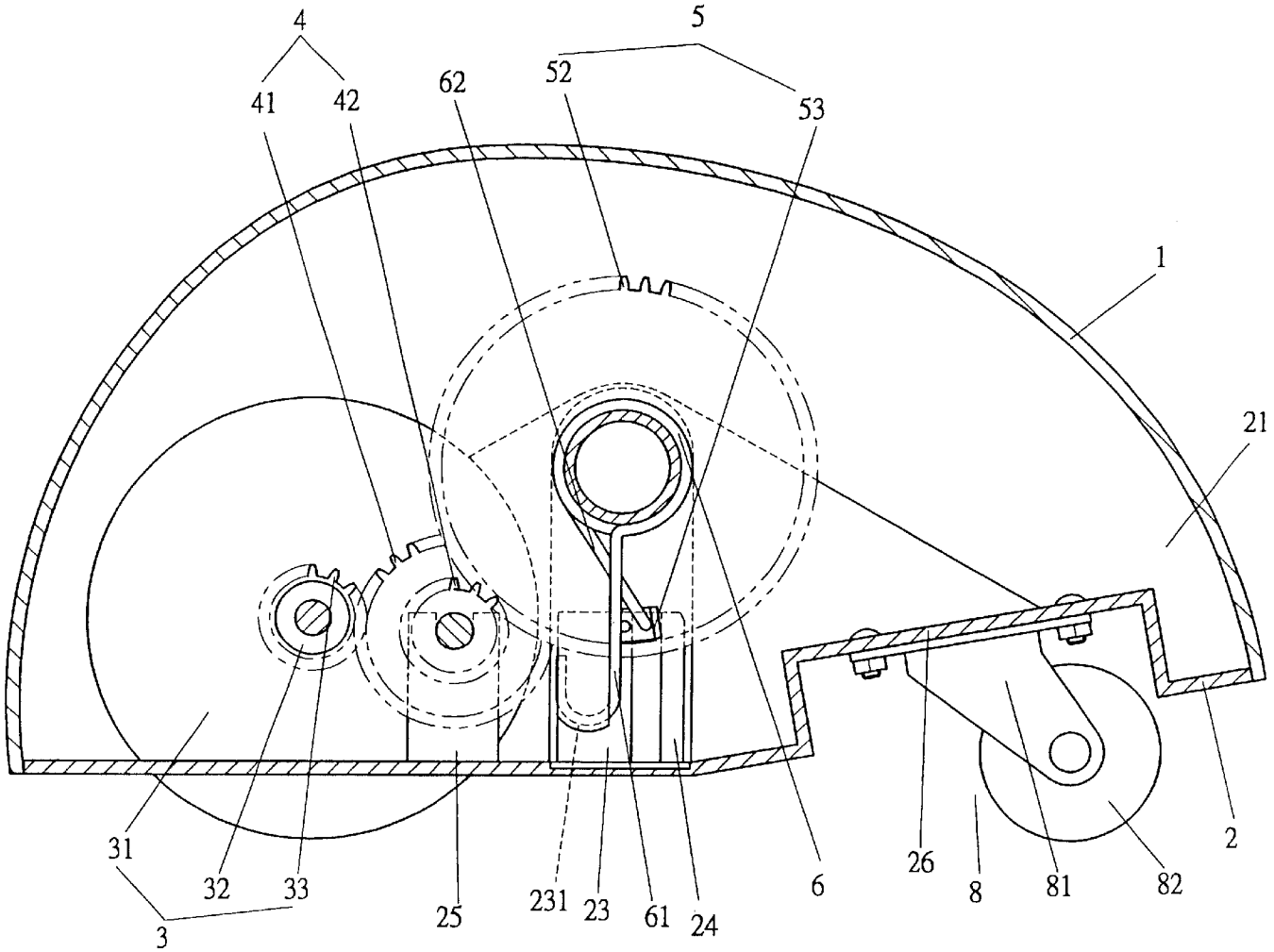
FIG. 2 is a sectional view of the exercise wheel in FIG. 1.

Referring to FIGS. 1 through 5 and initially to FIGS. 1 and 2, a first embodiment of an exercise wheel in accordance with the present invention generally includes a housing 1, a chassis 2, a pair of rollers 3, a transmission gear 4, a main gear 5, two torsion springs 6, and two grip rods 7.

The housing 1 includes aligned holes 11 in two sides thereof into which two tubes 22 are inserted. The chassis 2 includes a compartment 21 for mounting the rollers 3, transmission gear 4, main gear 5, and torsion springs 6. An end of each tube 22 is inserted into a hole 28 defined in each side wall 27 of the chassis 2. In this embodiment, two spaced spring-mounting sections 23 are formed on the chassis 2 adjacent to the side walls 27. Each spring-mounting section 23 includes a substantially U-shape groove 231 for engaging with an end 61 of an associated torsion spring 6. Each spring-mounting section 23 further includes a stop 24 to restrain travel of the exercise wheel and to prevent backward displacement of the exercise wheel. The chassis 2 further includes two spaced gear-mounting walls 25 each having a notch 251 for mounting the transmission gear 4, which will be described later. The chassis 2 further includes a caster-mounting portion 26 for mounting a universal caster 8.

The pair of rollers 3 includes two rollers 31 connected by a shaft 32 having a toothed portion 33. Each roller 3 may include an outer peripheral portion made of rubber material or constructed to engage with a rubber ring or the like to thereby provide smooth rotation with low noise. The main gear 5 includes an axle hole 51 so as to be rotatably mounted between the side walls 27 of the chassis 2. The main gear 5 further includes teeth 52 on an outer periphery thereof. The transmission gear 4 is mounted between the main gear 5 and the pair of rollers 3. The transmission gear 4 includes a gear shaft 44 having teeth 42 on an outer periphery thereof for meshing with the teeth 52 of the main gear 5, and teeth 41 of the transmission gear 4 mesh with the toothed portion 33 of the shaft 32. The teeth number of the teeth 41 of the transmission gear 4 is greater than that of the toothed portion 33 of the shaft 32. The number of the teeth 42 of the gear shaft 42 is less than that of the number of teeth 52 of the main gear 5. Thus, when the rollers 31 are turned for one turn (360°), the main gear 5 is rotated through a smaller angle less than 360°.

The main gear 5 further includes an attaching portion 53 on each side thereof to which the other end 62 of an associated torsion spring 6 is attached. Each torsion spring 6 is mounted around an associated tube 22 with two ends 61 and 62 thereof attached to the chassis 2 and an associated attaching portion 53, respectively. An end of each grip rod 7 is inserted into an associated tube 22 (see FIG. 4) and secured in place for the user's grasp. The universal caster 8 includes a caster 82 and a seat 81 so as to be attached to an underside of the chassis 2.

Figure 3:
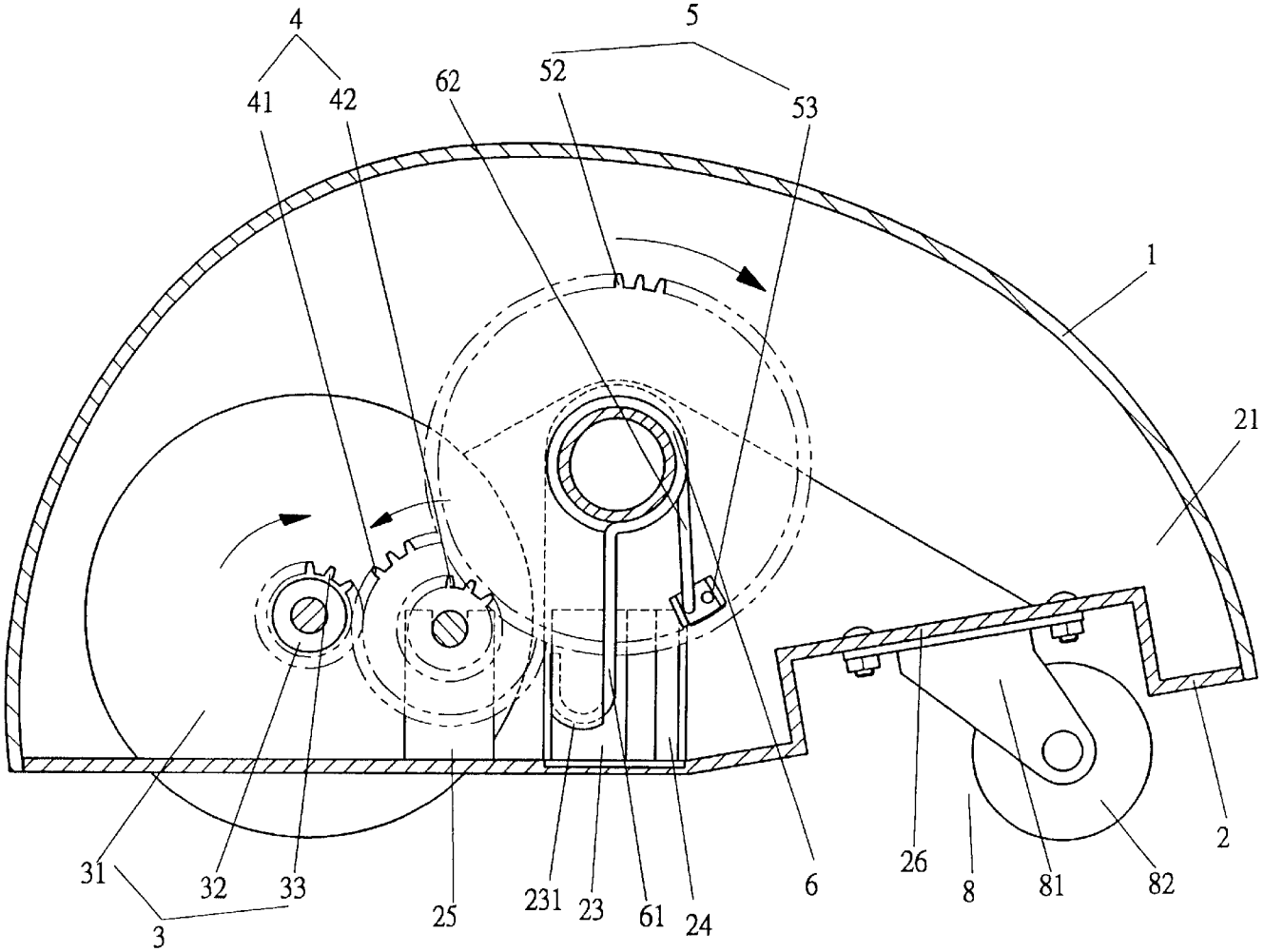
FIG. 3 is a sectional view similar to FIG. 2, illustrating operation of the exercise wheel.

Referring to FIG. 2, when not in use, each attaching portion 53 of the main wheel 5 abuts against an associated stop 24 by a first side of each attaching portion 53 to thereby prevent backward displacement of the main gear 5. Thus, reverse torsional deformation in the torsion springs 6 and consequent damage are prevented. Turning to FIG. 3, when the exercise wheel is in use, the shaft 32 of the pair of rollers 3 urges the main gear 5 to turn via transmission by the transmission gear 4. The torsion springs 6 are thus under tension. When the rollers 31 are turned for one turn (360°), the main gear 5 is rotated through a smaller angle less than 360°, for the number of the 41 of the transmission gear 4 is greater than that of the toothed portion 33 of the shaft 33 and the teeth number of the teeth 42 of the gear shaft 42 is less than that of the teeth 52 of the main gear 5 As a result, a longer travel of the exercise wheel can be obtained. In addition, deformation of the torsion springs 6 is little than that of the conventional exercise wheel such that the torsion springs 6 have a longer longevity. Further, each attaching portion 53 abuts against an associated stop 24 of the chassis 2 by a second side of each attaching portion 53 when the main gear 5 is rotated through 360° to thereby prevent further rotation of the main gear 5, thusly preventing damage to the torsion springs 6 resulting from excessive tension. The U-shape grooves 231 in the spring-mounting sections 23 of the chassis 2 provide secure engagement between U-shape ends 61 of the torsion springs 6, thereby preventing undesired disengagement of the ends 61 of the torsion springs 6 from the chassis 2 during operation of the exercise wheel.

Figure 4:
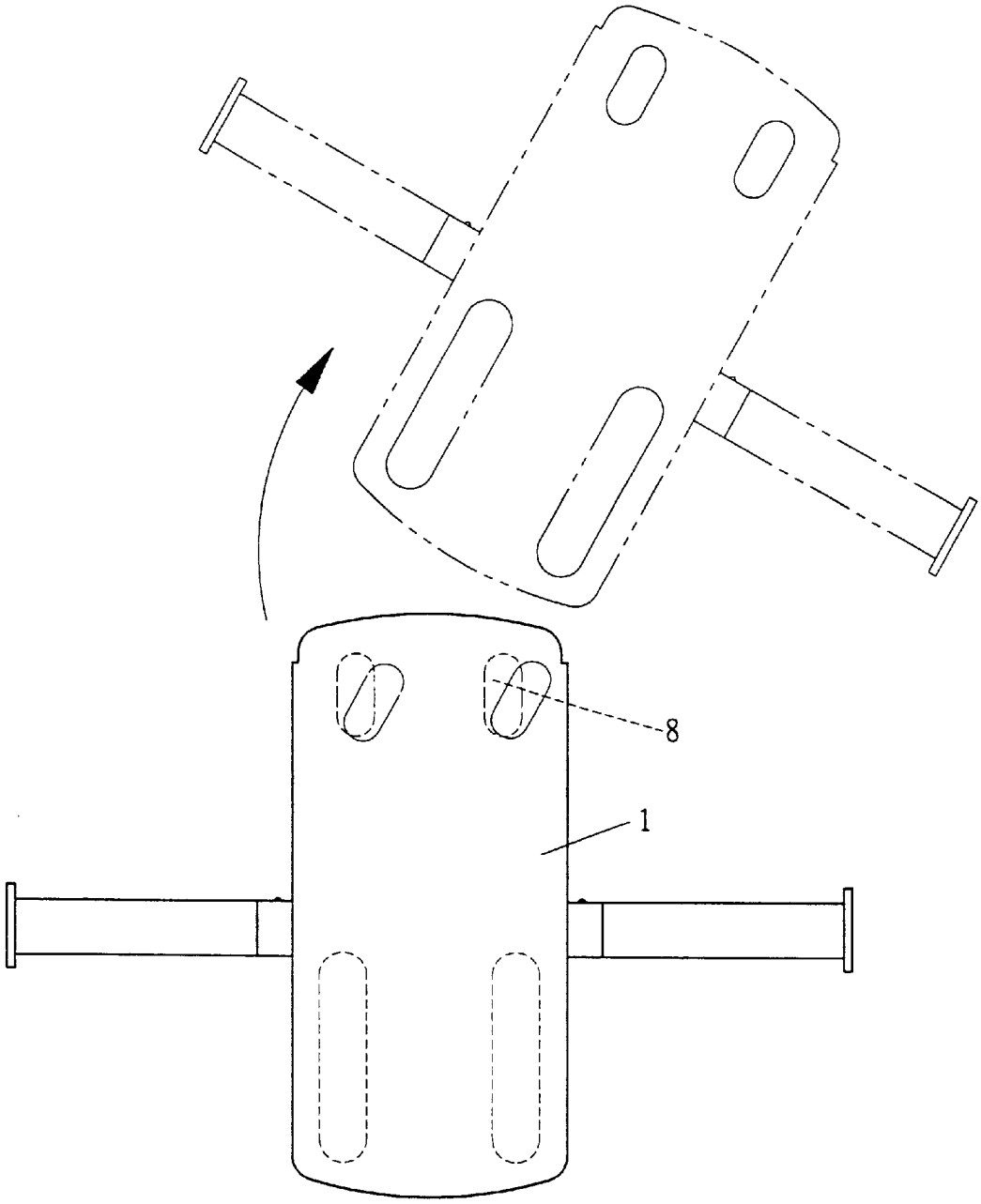
FIG. 4 is a schematic top view illustrating non-rectilinear travel of the exercise wheel.

Turning to FIG. 4, the exercise wheel may be moved curvilinearly due to provision of the universal caster 8.

Figure 5:
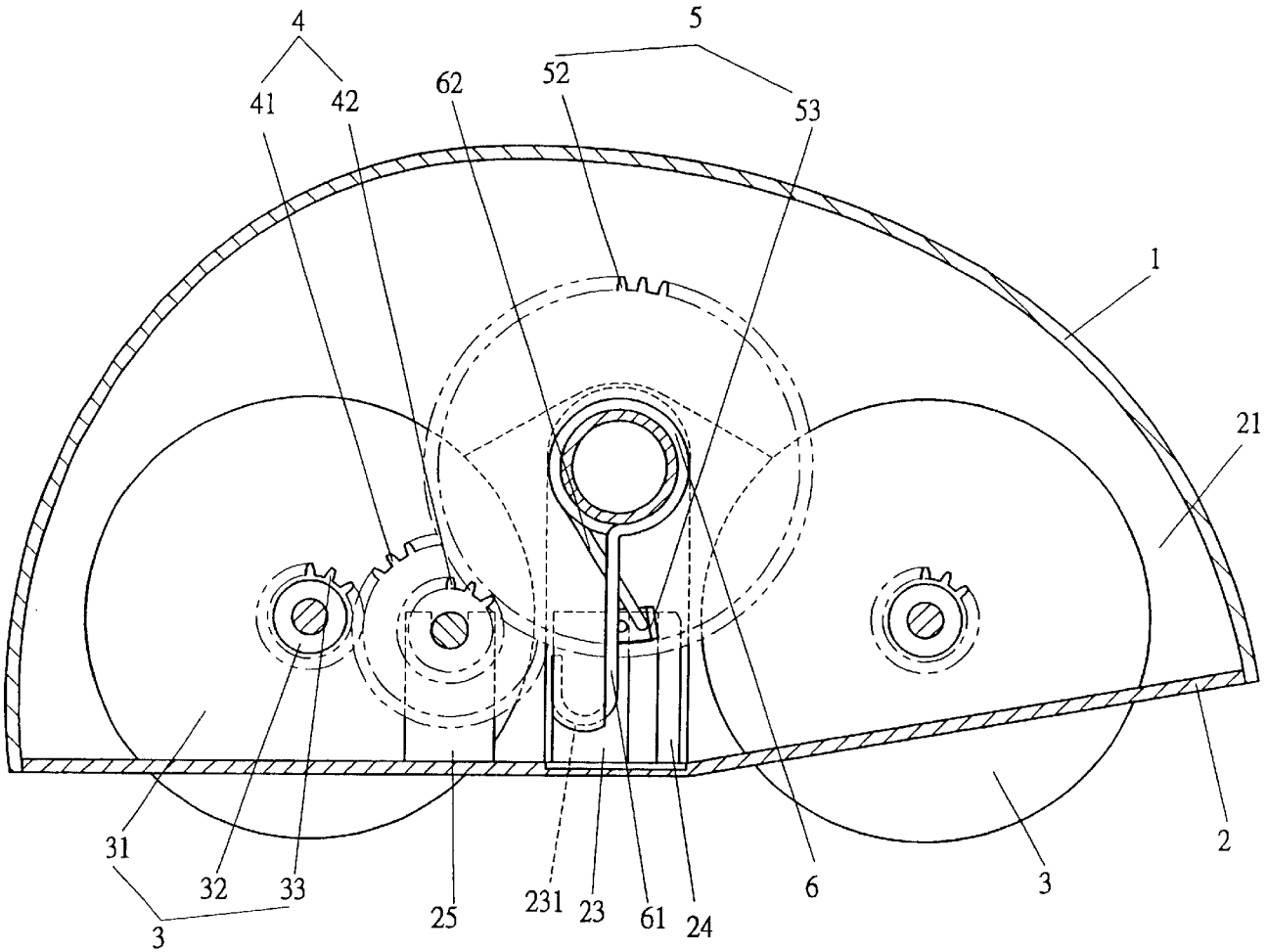
FIG. 5 is a sectional view of a second embodiment of the exercise wheel in accordance with the present invention.
Figure 6:
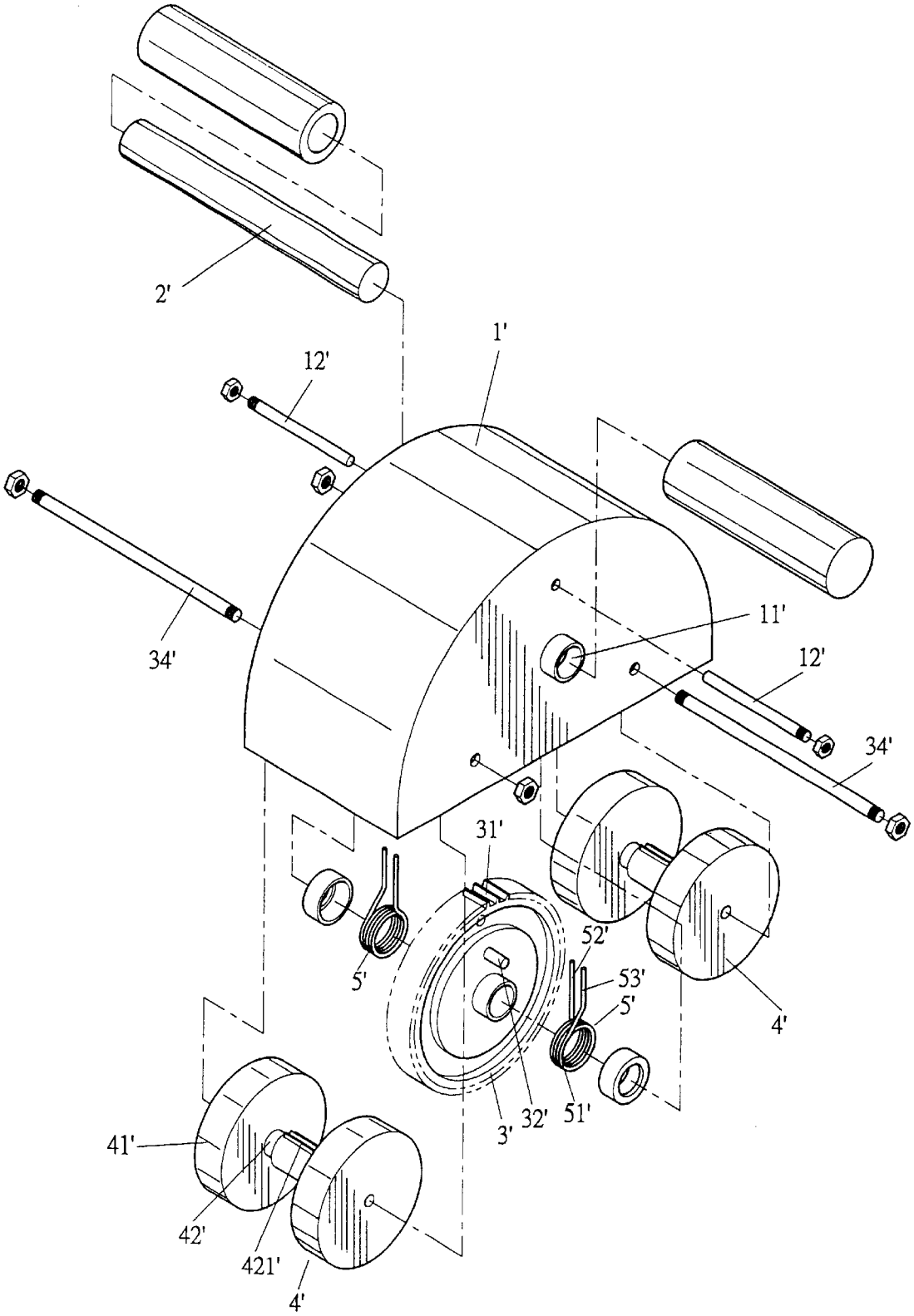
PRIOR ART FIG. 6
FIG. 6 is an exploded perspective view of a conventional prior art exercise wheel.
Figure 7:
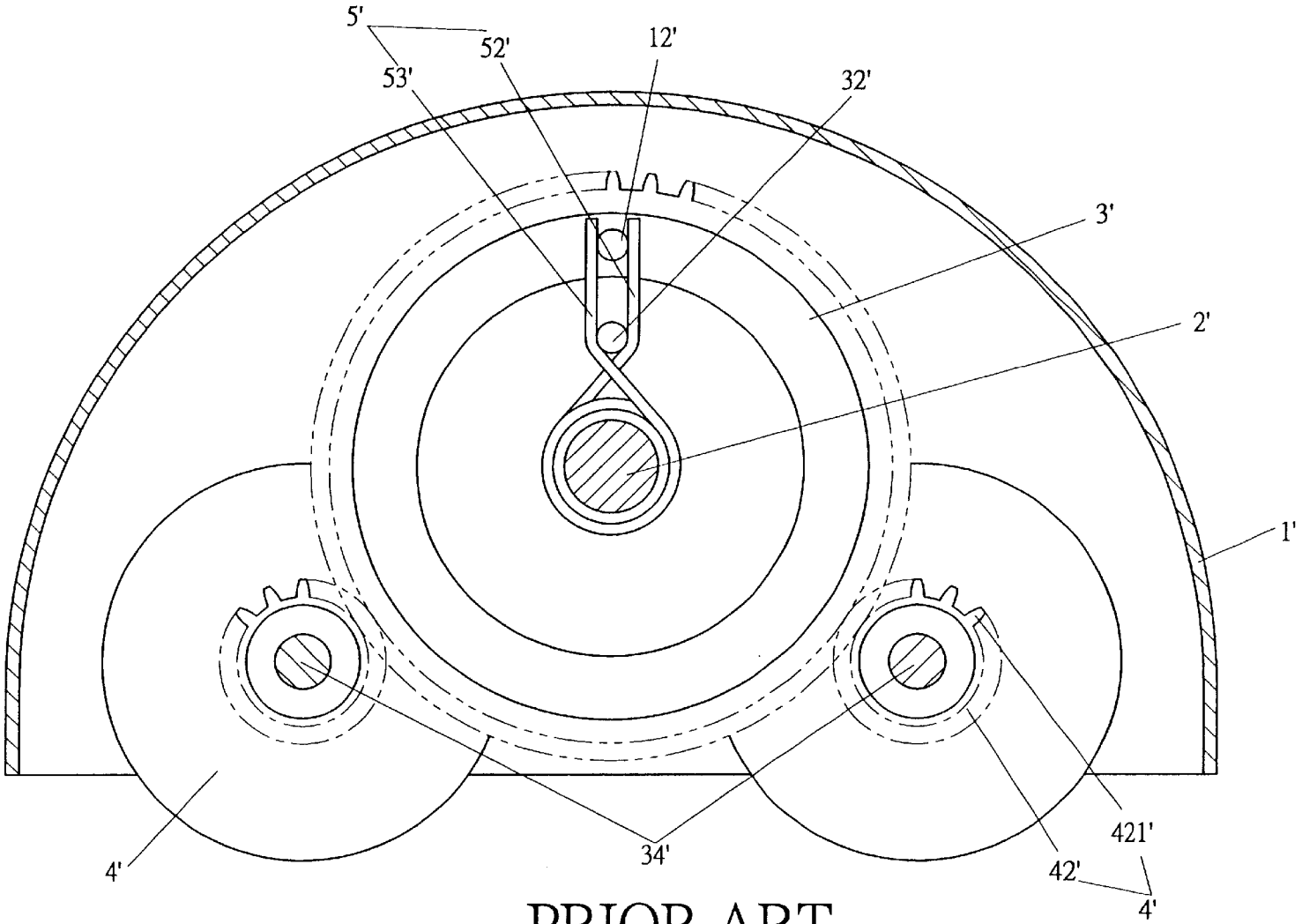
PRIOR ART FIG. 7
FIG. 7 is a sectional view of the conventional prior art exercise wheel.

Referring to FIG. 5, the caster 8 may be replaced by another pair of rollers 3 such that the exercise wheel may be moved rectilinearly only. An additional transmission gear 4 is provided to provide transmission between the additional rollers 3 and the main gear 5 in a manner identical to the above embodiment. The exercise wheel can be operated with less force and move by a longer travel in addition to protection of the torsion springs.

The rollers 3, transmission gear 4, and the main gear 5 can be replaced by other means, such as frictional belts, belts, or other suitable transmission means.

According to the above description, it is appreciated that the exercise wheel includes the following advantages when compared with the conventional exercise wheel:

1. Travel of the exercise wheel in accordance with the present invention is increased by providing the transmission gear 4.
2. Longer travel of the exercise wheel can be obtained even using a smaller main gear 5. The torsional deformation of the torsion springs 6 is reduced when the main gear 5 is rotated through 360°. Operation is easier and longevity of the torsion springs 6 is increased.
3. Reliable engagement between the ends 61 of the torsion springs 6 and the grooves 231 of the chassis 2 prevents disengagement of the ends 61 of the torsion springs 6 resulting from excessive torsional deformation of the ends 61 of the torsion springs 6.
4. The exercise wheel may be moved curvilinearly when a universal caster 8 is attached to the chassis 2.

Although the invention has been explained in relation to its preferred embodiment, it is to be understood that many other possible modifications and variations can be made without departing from the spirit and scope of the invention as hereinafter claimed.

What is claimed is:

1. An exercise wheel comprising:

a housing having two sides, a chassis housed by the housing and including a compartment, a pair of rollers rotatably mounted in the compartment of the chassis and connected by a shaft, a main gear rotatably mounted in the compartment of the chassis and having two sides, means for providing transmission between the shaft of the rollers and the main gear, a pair of torsion springs respectively mounted to the two sides of the main gear and each having a first end and a second end, the first end of each said torsion spring being attached to an associated said side of the main gear, the second end of each said torsion spring being attached to the chassis, each said torsion spring being deformed to store resilience when the main gear is turned, thereby returning the main gear, two grip rods secured to the two sides of the housing, respectively, and a universal caster mounted to an underside of the chassis, thereby allowing the user to change moving direction of the exercise wheel.

2. The exercise wheel as claimed in claim 1, wherein the rollers, the main gear, the torsion springs, and the universal casters are directly mounted inside the housing.

3. The exercise wheel as claimed in claim 1, wherein said means for providing transmission between the shaft of the rollers and the main gear is a transmission gear including a gear shaft, the gear shaft having a plurality of teeth on an outer periphery thereof for meshing with teeth of the main gear, the shaft for connecting the rollers including a toothed portion for meshing with teeth of the transmission gear.

4. The exercise wheel as claimed in claim 3, wherein a teeth number of the teeth of the transmission gear is greater than that of the toothed portion of the shaft and a teeth number of the teeth of the gear shaft is less than that of the teeth of the main gear.

5. An exercise wheel comprising:

a housing having two sides, a chassis housed by the housing and including a compartment, a pair of rollers rotatably mounted in the compartment of the chassis and connected by a shaft, a main gear rotatably mounted in the compartment of the chassis and having two sides, a transmission gear for providing transmission between the shaft of the rollers and the main gear, the transmission gear been so constructed that the main gear is rotated through an angle less then 360° when the rollers are turned through 360°, a pair of torsion springs respectively mounted to the two sides of the main gear and each having a first end and a second end, the first end of each said torsion spring being attached to an associated side of the main gear, the second end of each said torsion spring being attached to the chassis, two grip rods secured to the two sides of the housing, respectively, and at least one universal roller mounted on the underside of the chassis, thereby allowing the user to change moving direction of the exercise wheel.

6. The exercise wheel as claimed in claim 5, wherein the rollers, the main gear, the torsion springs, and the universal casters are directly mounted inside the housing.

7. The exercise wheel as claimed in claim 5, wherein transmission between the rollers, the transmission gear, and the main gear includes friction transmission.

8. The exercise wheel as claimed in claim 5, wherein the chassis includes two spaced gear-mounting walls each having a notch for rotatably receiving a gear shaft of the transmission gear.

9. The exercise wheel as claimed in claim 8, further comprising a second pair of rollers rotatably mounted to the chassis, a second transmission gear for providing transmission between the second rollers and the main gear, the chassis further including two spaced second mounting walls each having a notch for rotatably receiving a gear shaft of the second transmission gear.

10. The exercise wheel as claimed in claim 5, wherein said transmission gear includes a gear shaft, the gear shaft having a plurality of teeth on an outer periphery thereof for meshing with teeth of the main gear, the shaft for connecting the rollers including a toothed portion for meshing with teeth of the transmission gear.

11. The exercise wheel as claimed in claim 5, further comprising two more transmission gears for providing transmission between the rollers and the main gear.

* * * * *